US008281512B2

(12) United States Patent
Lara

(10) Patent No.: US 8,281,512 B2
(45) Date of Patent: Oct. 9, 2012

(54) SYSTEM AND METHOD FOR CARRYING FIREARMS

(76) Inventor: David Lara, Deerfield Beach, FL (US)

( * ) Notice: Subject to any disclaimer, the term of this patent is extended or adjusted under 35 U.S.C. 154(b) by 0 days.

(21) Appl. No.: 12/952,355

(22) Filed: Nov. 23, 2010

(65) Prior Publication Data

US 2012/0124882 A1 May 24, 2012

(51) Int. Cl.
*F41C 33/04* (2006.01)

(52) U.S. Cl. ..... 42/85; 42/106; 42/71.01; 224/198

(58) Field of Classification Search ..... 42/85, 71.01, 42/72, 106, 90; 224/149, 197, 911, 912, 224/198, 243
See application file for complete search history.

(56) References Cited

U.S. PATENT DOCUMENTS 5,918,784 A 7/1999 Serpa
6,250,194 B1 * 6/2001 Brandl et al. ..... 89/1.41
6,481,145 B2 * 11/2002 Weichert et al. ..... 42/105
6,829,858 B2 * 12/2004 Gablowski ..... 42/105
7,540,107 B2 * 6/2009 Oum ..... 42/71.01
2003/0075574 A1 * 4/2003 Mossman ..... 224/198
2007/0194067 A1 * 8/2007 Lowe et al. ..... 224/243
2008/0000131 A1 * 1/2008 Oum ..... 42/71.01
2011/0225865 A1 * 9/2011 Williams ..... 42/90

OTHER PUBLICATIONS

Brochure from Elite Tactical Weapons L.L.C, Shreveport, LA. www.tacticalgear.com.

* cited by examiner

*Primary Examiner* — Benjamin P Lee
(74) *Attorney, Agent, or Firm* — David W. Barman

(57) ABSTRACT

A system is provided for simultaneously carrying two firearms is provided wherein said system has a first firearm; a receiving bracket attached to said first firearm; a second firearm having a trigger; a holster housing said second firearm, said holster having a mounting bracket acting in concert with said receiving bracket such that said mounting bracket is releasably attached to said receiving bracket, and wherein said holster restricts access to said trigger of said second firearm housed within said holster.

6 Claims, 7 Drawing Sheets

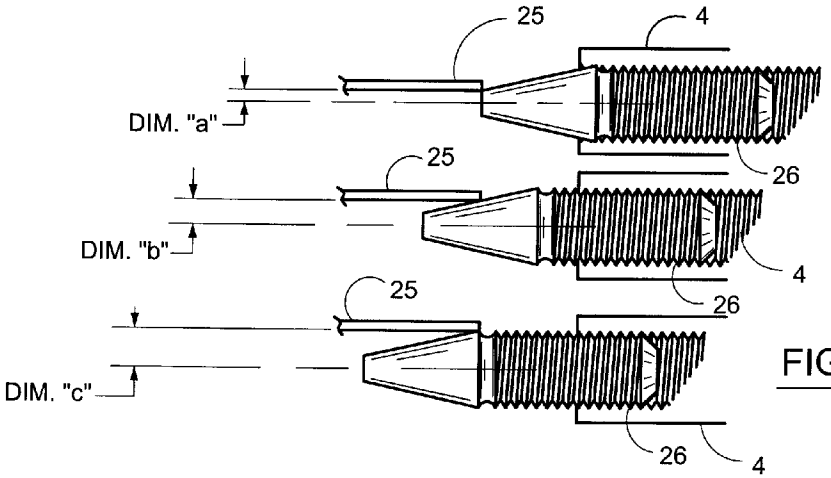
FIG.16
FIG.17
FIG.18
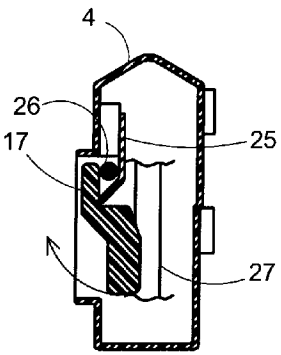
SECTION A-A
FIG.3A
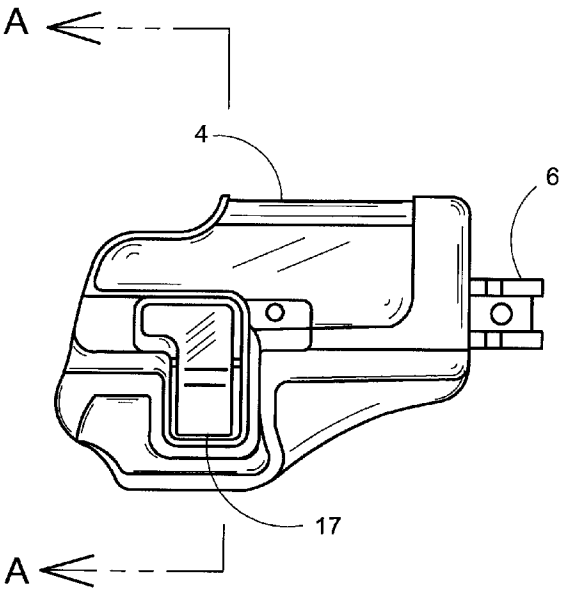
FIG.3

SYSTEM AND METHOD FOR CARRYING FIREARMS

BACKGROUND OF THE INVENTION

The U.S. Constitution guarantees the right to bear arms. However, settled case law provides that the government is allowed to place limitations on this right.

In the United States, firearms are regulated, inter alia, by the National Firearms Act (NFA) codified in 26 USC Chapter 53.

The Act makes certain conduct a criminal offense, including but not limited to: receiving or possessing a firearm made in violation of the NFA; and transferring or making a firearm in violation of the NFA.

Violations of the Act are punishable by up to 10 years in federal prison and forfeiture of all devices or firearms in violation, and the individual's right to own or possess firearms in the future. The Act provides for a penalty of $10,000 for certain violations. A willful attempt to evade or defeat a tax imposed by the Act is a felony punishable by up to five years in prison and a $100,000 fine ($500,000 in the case of a corporation or trust), under the general tax evasion statute. For an individual, the felony fine of $100,000 for tax evasion could be increased to $250,000.

One particular device, typically covered under NFA regulations, is the carrying of a device in which two separate firearms are able to be discharged from a joined unit. This would mean, a person could not make, purchase, or use two joined firearms without violating certain aspects of the NFA.

The present invention addresses this law by providing a system and method by which two firearms, a primary firearm and a secondary firearm may be singly carried, but only the primary firearm can be discharged in the single carry arrangement. The trigger of the second firearm is inaccessible in the single carry arrangement.

BRIEF SUMMARY OF THE INVENTION

The present invention is a system and method for simultaneously carrying two firearms wherein one firearm is placed in a holster that completely prevents access to the trigger. The firearm in the holster can only be fired when removed from a holster and the holster locks the firearm therein. The system comprises:

a first firearm;

a receiving bracket attached to said first firearm;

a second firearm having a trigger;

a holster housing said second firearm, said holster having a mounting bracket acting in concert with said receiving bracket such that said mounting bracket is releasably attached to said receiving bracket, and wherein said holster restricts access to said trigger of said second firearm housed within said holster.

The first firearm has a pair of opposing sides and a receiving bracket is attached to a side of said first firearm. The term "side" being determined when said first firearm is held in a conventional shooting position. In general, the first firearm is held in position for use. A proximal end of the first firearm is near the user, and a distal end, terminating at the end of a barrel is distal from the user.

The receiving bracket is attached distal to a user and the attachment is positioned to avoid obstruction and interference with aiming and discharging said first firearm. In general, the placement of the bracket is along the barrel portion of the first firearm. But, the bracket can be anywhere that does not interfere with accessing the trigger of the first firearm, and the aiming and firing of the first firearm.

The holster releasably locks said second firearm therein. The holster has a spring tension release tab that releasably locks said second firearm therein and releases said second firearm upon actuation of a said spring tension release tab. As stated above, the holster must perform each of locking the second firearm therein, and completely restrict access to the trigger of the second firearm.

In one embodiment, the spring tension release tab is adjustable and adjusts a tension required for release of second firearm in said holster. Tension adjustment can be by providing a set screw tension adjust as described herein, or other spring tension adjust configurations as is known in the art.

In one embodiment, either of the first, second, or both firearms can be a non-lethal weapon such as a weapon for discharging rubber bullets or a taser.

BRIEF DESCRIPTION OF THE DRAWINGS

FIG. 3 is partial side view of a sidearm holster and release device.

FIG. 3A is a cross section from FIG. 3 showing holster in which a trigger is inaccessible.

FIG. 16 is a partial side cut away view showing position of a first tension adjust of a tension release tab.

FIG. 17 is a partial side cut away view showing position of a second tension adjust of a tension release tab.

FIG. 18 is a partial side cut away view showing position of a third tension adjust of a tension release tab.

DETAILED DESCRIPTION OF THE PREFERRED EMBODIMENT

Figure 1:
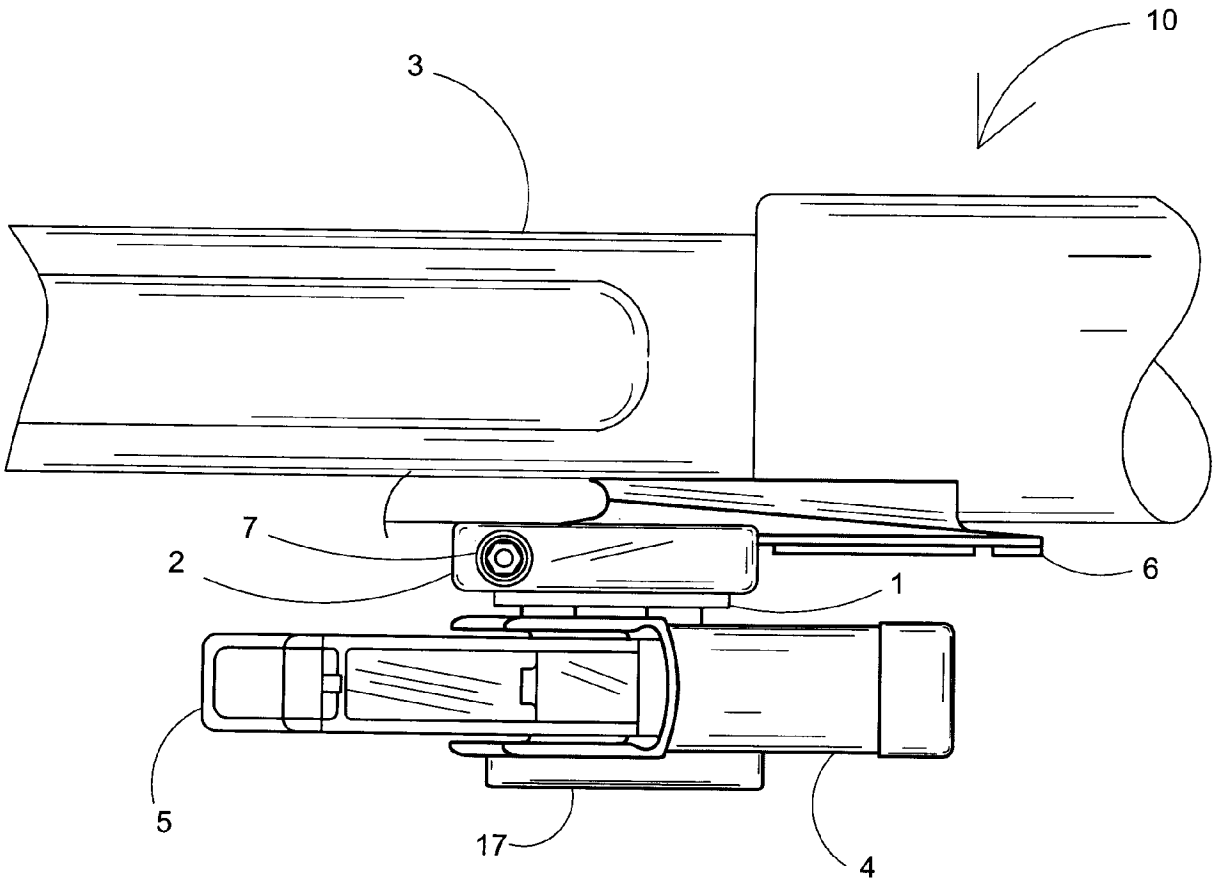
FIG. 1 is a top view of a rifle having side-mounted connection bracket in which a holstered side arm is attached.

Firearm assembly 10 has a first firearm 3 and a second firearm 5. In a preferred embodiment, first firearm 3 is a rifle or other firearm with an elongated configuration and second firearm 5 is a sidearm such as a pistol and the like. First firearm 3 has affixed thereto connector 6. Connector 6 is constructed and arranged to interact with and receive holster bracket 2. Connector 6 has a pair of clamping surfaces ** that define central channel 20. Central channel 20 mates with holster bracket 2 such that holster bracket 2 can slidably attach and detach from a mated secured position in central channel 20. The invention includes use of a holster 4 to hold second firearm 5 in position. Holster 4 is constructed and arranged such that the trigger of second firearm 5 is not accessible when second firearm 5 is placed therein. Furthermore, holster 4 has a lock mechanism formed such that the only way to access the trigger of second firearm 5 is to release second firearm 5 and remove it completely from holster 4. Once second firearm 5 is released and removed from holster 4**, the user has two separate, distinct, detached firearms in which to use.

Holster 4 has connection plate 1 affixed on one side. Connection plate 1 is affixed using peripheral mounting screws 11 and clamp screws 16. Connection plate 1 receives bracket 2 through attachment with securing screws passed through bracket 2 at primary mounting orifice 15 and each of two secondary mounting orifices 14. Clamp screw 7 adjusts relative distance between 22 and 24 and alters the width of central bracket channel 13. Clamp screw 7 ultimately affects the mating and securing of bracket 2 into connector 6.

In use, connector 6 is affixed to first firearm 3. Connector 6 is any acceptable connector in order to function as described in the present invention.

Connector 6 is an acceptable adapter that will not significantly alter or interfere with the ability of a user to use firearm 3.

Figure 2:
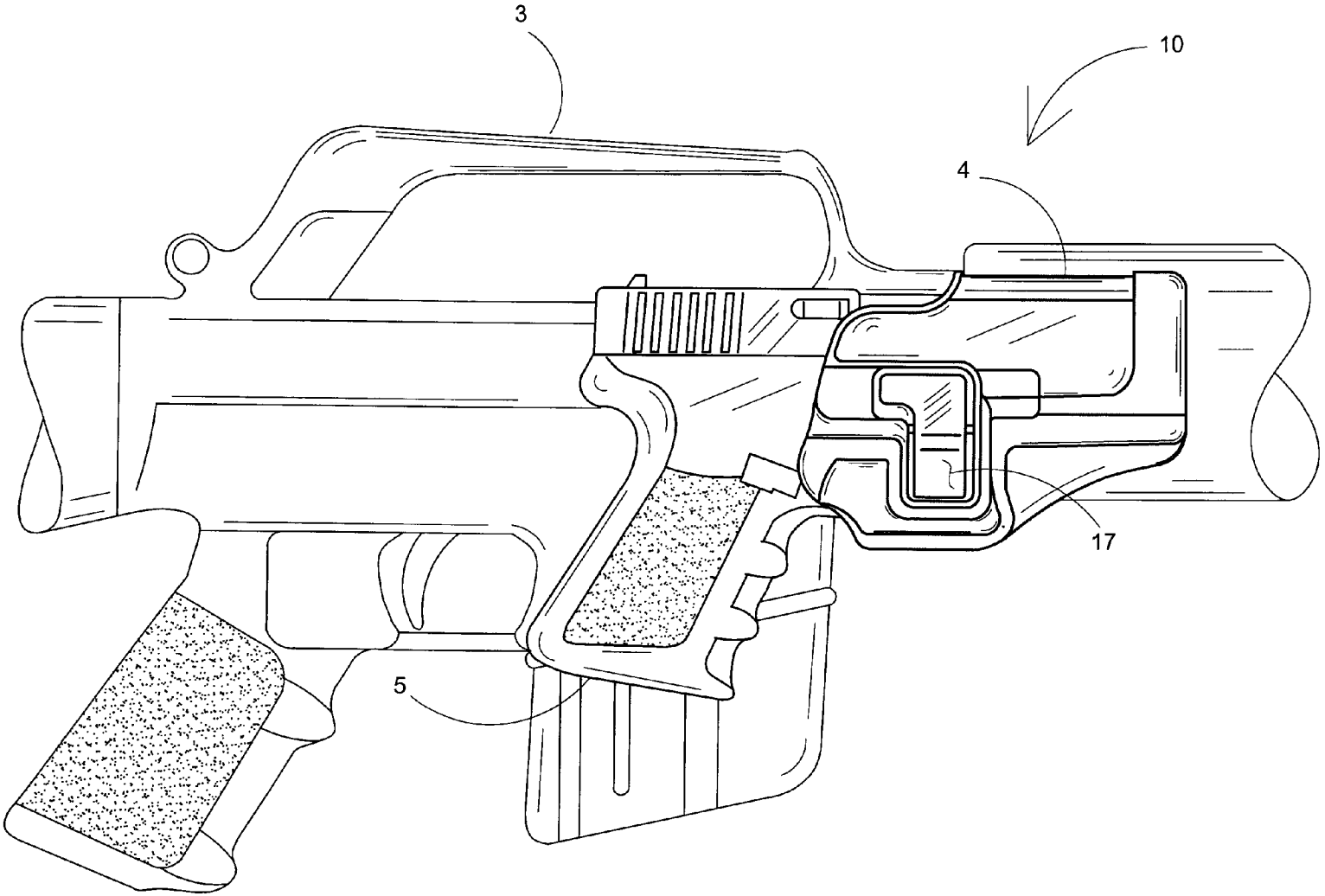
FIG. 2 is a side view of a rifle having side-mounted connection bracket in which a holstered side arm is attached.
Figure 5:
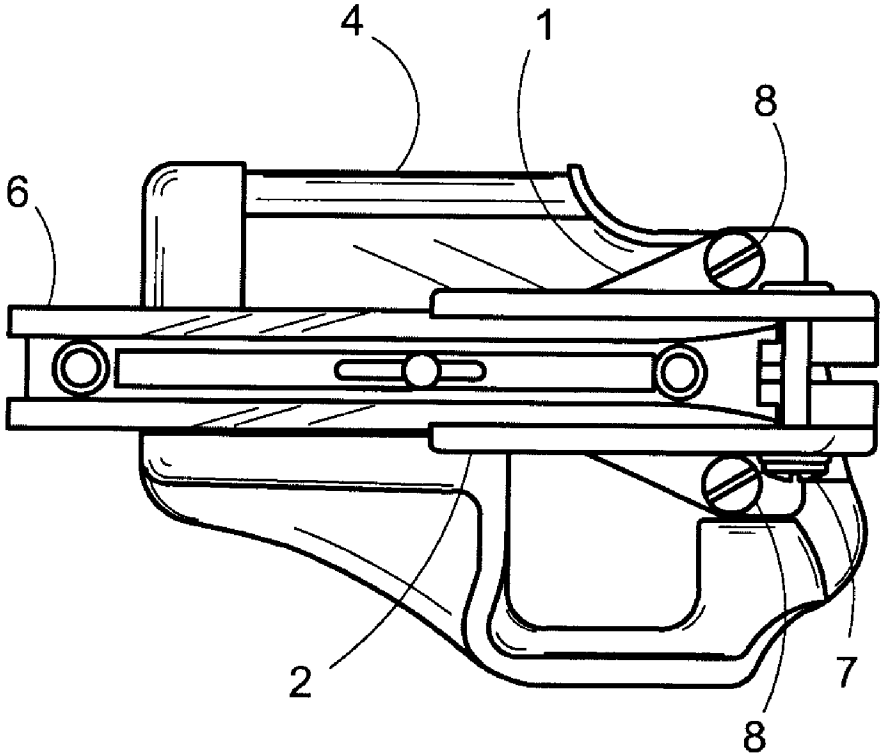
FIG. 5 is a partial side view of the bracket device affixed to a sidearm holster.
Figure 4:
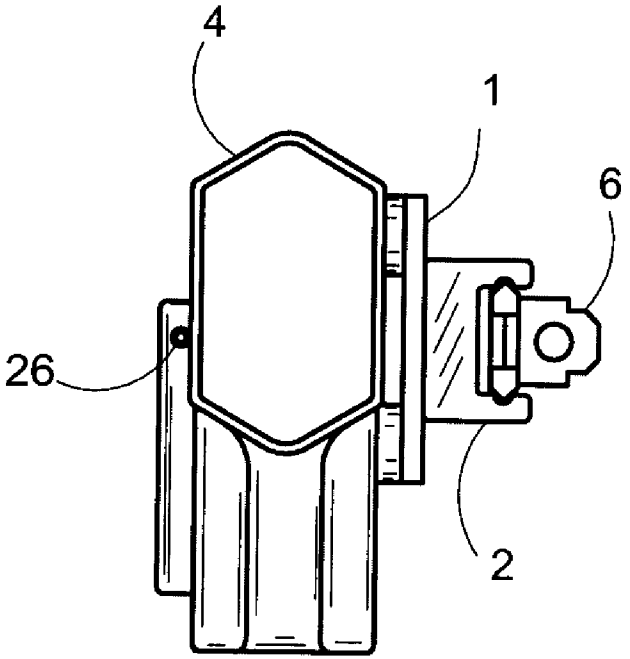
FIG. 4 is a partial front view of a sidearm holster and bracket device.
Figure 6:
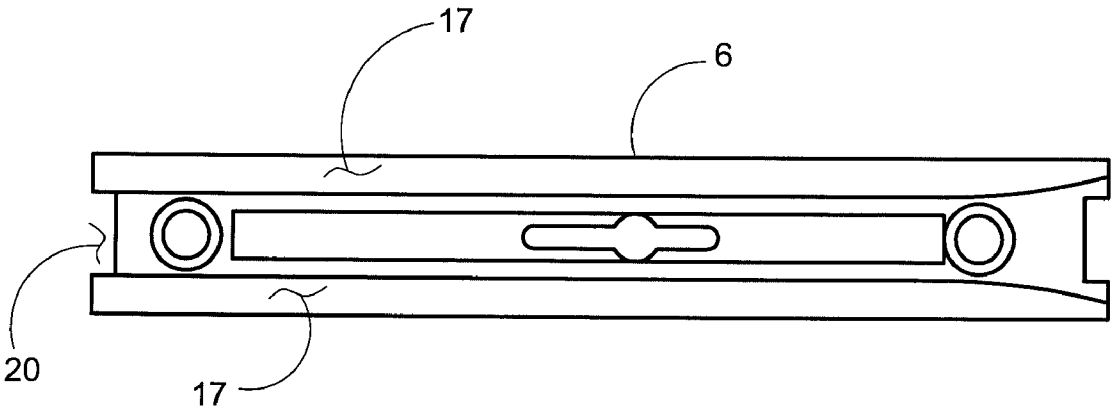
FIG. 6 is a top view of the bracket device that is to be attached to the rifle.
Figure 7:
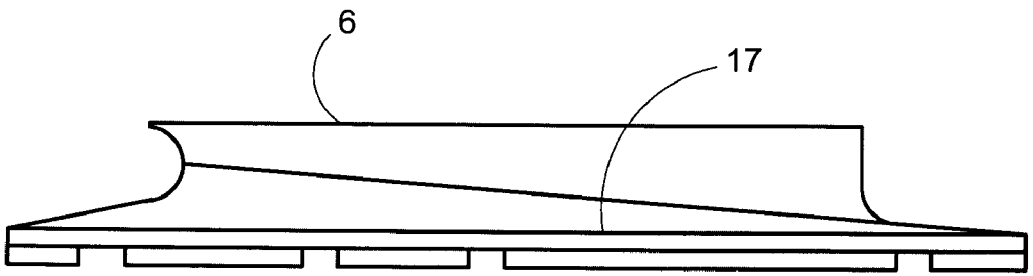
FIG. 7 is a side view of the bracket device that is to be attached to the rifle.
Figure 8:
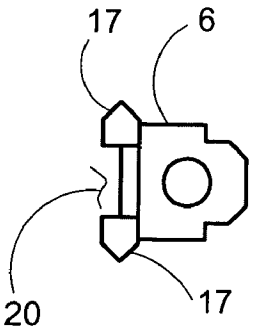
FIG. 8 is an end view of the bracket device that is to be attached to the rifle.
Figure 10:
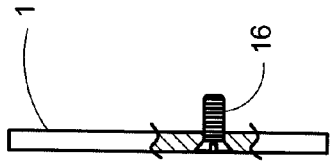
FIG. 10 is a side view of a connection plate.
Figure 9:
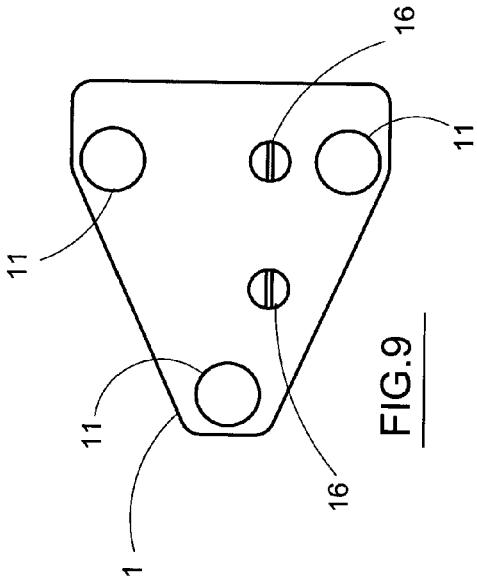
FIG. 9 is a top view of a connection plate.
Figure 13:
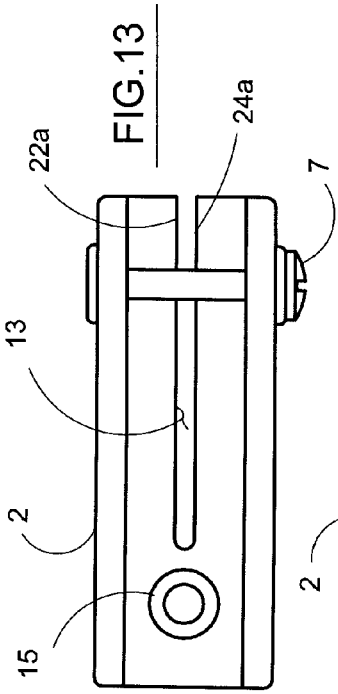
FIG. 13 is a bottom view of a bracket and clamp screw device.
Figure 14:
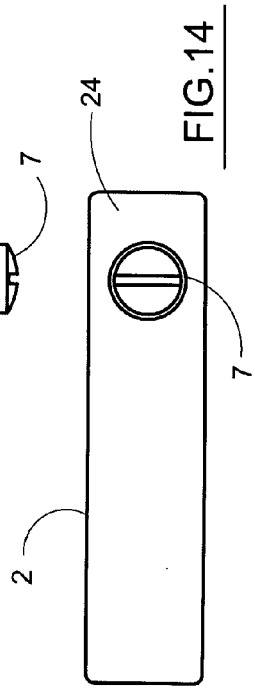
FIG. 14 is a side view of a bracket and clamp screw device.
Figure 12:
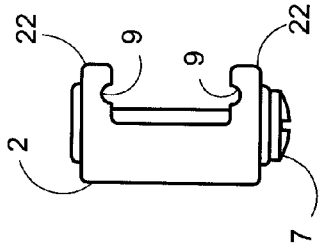
FIG. 12 is an end view of a bracket and clamp screw device.
Figure 11:
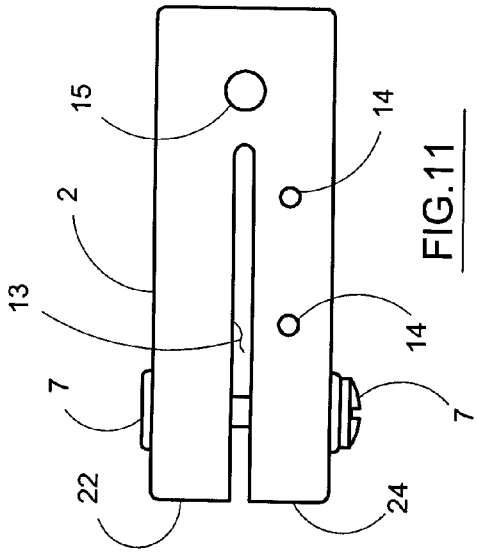
FIG. 11 is a top view of a bracket and clamp screw device.
Figure 15:
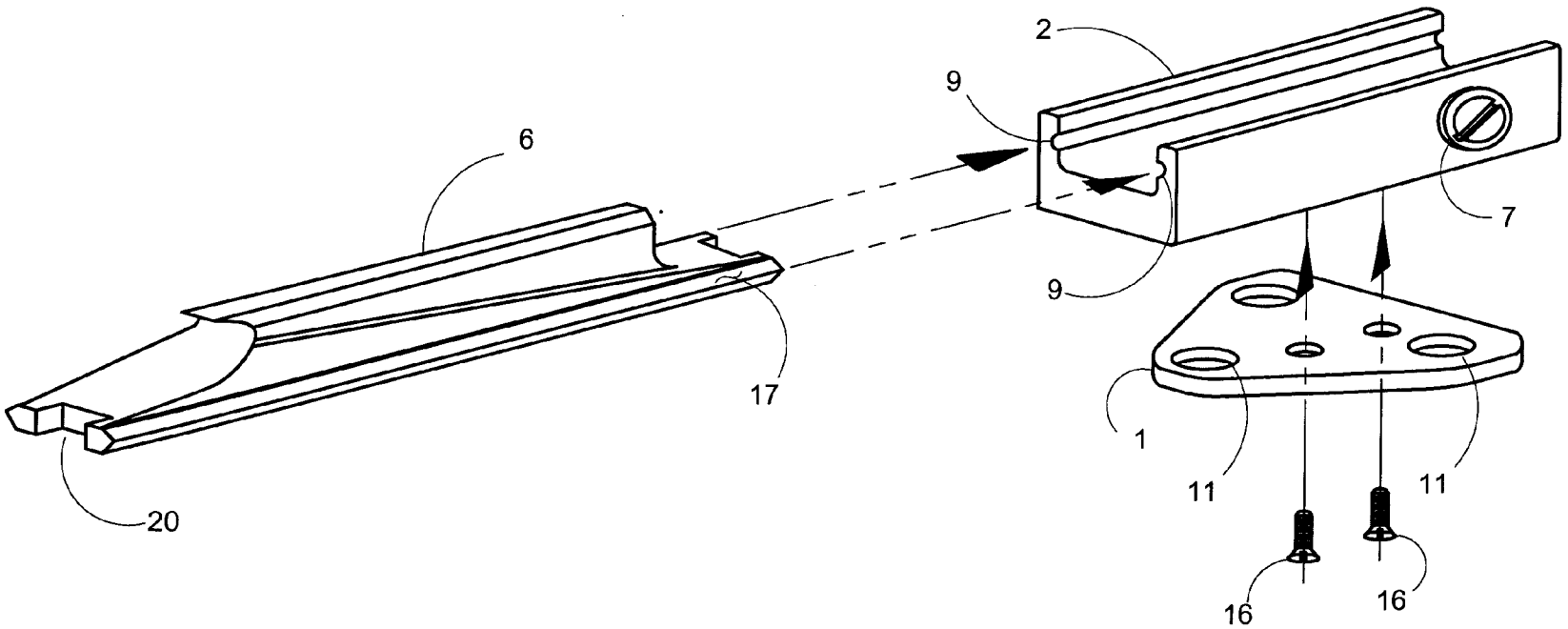
FIG. 15 is a perspective view showing positioning of holster bracket and connector prior to attachment.

As discussed above, various laws in the United States and other countries govern the carrying of a firearm having separate firing mechanisms in a single or singly connected unit. The present invention addresses and overcomes this difficulty by a carrying configuration in which second firearm 5 cannot be fired while attached to first firearm 3. The trigger 27 of second firearm 5 is completely covered and inaccessible when placed in holster 4. Although various embodiments of holster 4 are commercially available from retailers (such as Blackhawk! Products Group, Norfolk, Va.), no such system exists whereby a second firearm 5 is attached to a first firearm 2 in which each are singly carried, while only a single firearm can be discharged. AS seen in FIGS. 2 and 3, second firearm 5 is enveloped in holster 4 such that trigger 27 is only accessible by actuating tension release 17. The actuating of tension release 17 unlocks or releases second firearm 5 and permits second firearm 5 to be withdrawn from holster 4. Withdrawn firearm 5 is now separate from the combined carry arrangement and a user will have access to two separate firearms. In one embodiment, as seen in FIG. 3A, tension spring 25 that controls tension release 17 is adjustable. Adjustment of the required tension is by a set screw adjustment 26, or any other means known in the art for providing tension adjustments of spring tension devices. One embodiment, as shown in FIGS. 16-18 shows tension adjust screw 26 interacting with tension spring 25. FIG. 16 shows tension adjust screw 26 with a tapered end urging against tension spring 25 such that a first offset distance defined by dimension "a" is created. FIG. 17 shows tension adjust screw 26 with a tapered end urging against tension spring 25 such that a second offset distance defined by dimension "b" is created. FIG. 16 shows tension adjust screw 26 with a tapered end urging against tension spring 25 such that a third offset distance defined by dimension "c" is created. With each increased offset distance, the effect is increased tension on tension release 17. Regardless of the tension applied to tension release 17, even when no extra tension is applied, second firearm 5 remains connected into holster 4 and trigger 27 of second firearm 5 is inaccessible.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

I claim:

1. A system for simultaneously carrying two firearms comprising:

a first firearm;

a receiving bracket attached to said first firearm distal to a user and forward from the trigger towards the barrel;

a second firearm having a trigger;

a holster housing said second firearm, said holster having a mounting bracket acting in concert with said receiving bracket such that said mounting bracket is releasably attached to said receiving bracket and said mounting bracket is constructed to release from said receiving bracket while said receiving bracket remains in place, and wherein said holster restricts access to said trigger of said second firearm housed within said holster.

2. The system of claim 1, wherein said first firearm has a pair of opposing sides and said receiving bracket is attached to a side of said first firearm, said side being determined when said first firearm is held in a conventional shooting position.

3. The system of claim 1, wherein said receiving bracket is attached distal to a user, said attachment positioned to avoid obstruction and interference with aiming and discharging said first firearm.

4. The system of claim 1, wherein said holster releasably locks said second firearm therein.

5. The system of claim 1, wherein said holster having a spring tension release tab, said holster releasably locks said second firearm therein and releases said second firearm upon actuation of a said spring tension release tab.

6. The system of claim 5, wherein said spring tension release tab is adjustable and adjusts a tension required for release of second firearm in said holster.

* * * * *